United States Patent [19]

Kalb

[11] Patent Number: 5,046,265

[45] Date of Patent: Sep. 10, 1991

[54] METHOD AND SYSTEM FOR REDUCING THE MOISTURE CONTENT OF SUB-BITUMINOUS COALS AND THE LIKE

[76] Inventor: G. William Kalb, 190 Oakmont Rd., Wheeling, W. Va. 26003

[21] Appl. No.: 445,499

[22] Filed: Dec. 4, 1989

[51] Int. Cl.[5] ..... F26B 5/04

[52] U.S. Cl. ..... 34/15; 34/22

[58] Field of Search ..... 34/17, 60, 68, 17, 15, 34/92, 10, 57 A

[56] References Cited

U.S. PATENT DOCUMENTS

| | | | |
|---|---|---|---|
| 4,303,477 | 12/1981 | Schmidt et al. | 110/246 |
| 4,502,227 | 3/1985 | Janusch | 34/15 |
| 4,514,910 | 5/1985 | Elmore et al. | 34/15 |
| 4,514,912 | 5/1985 | Janusch et al. | 34/15 |
| 4,619,052 | 10/1986 | Osburn et al. | 34/15 |
| 4,628,619 | 12/1986 | Janusch et al. | 34/15 |
| 4,903,414 | 2/1990 | White | 34/60 |

*Primary Examiner*—Henry A. Bennett
*Assistant Examiner*—Denise L. F. Gromada
*Attorney, Agent, or Firm*—Clifford A. Poff

[57] ABSTRACT

The present invention proposes a method and system for addressing the specific processing requirements which must be satisfied to successfully thermally dry sub-bituminous materials in order to raise the heating values of such materials to levels approximating those of bituminous coals. In addition, the present invention proposes a new integration of technical mechanisms to satisfy these requirements, which, in addition to being unique from an overall process perspective, incorporates several individually unique components and subsystems. The invention further includes systems and methods for restructuring such thermally dried materials into commercially usable handleable and marketable fuel product.

43 Claims, 1 Drawing Sheet

METHOD AND SYSTEM FOR REDUCING THE MOISTURE CONTENT OF SUB-BITUMINOUS COALS AND THE LIKE

BACKGROUND OF THE INVENTION

1. Field of the Invention

The present invention relates generally to methods and apparatus for treating relatively low heating value fuel products, and, more particularly, to an integrated method and system for reducing the moisture content of sub-bituminous coal products, and the like, to produce improved fuel products having heating values comparable to those of bituminous coals.

2. Description of the Prior Art

Since 1975, the production and utilization of sub-bituminous coals (especially those produced in Wyoming's Powder River Basin) has increased dramatically, and today, comprise about 15% of the nation's coal production. Because of the very low sulfur content of these coals (and their resultingly low sulfur dioxide emission potential), it is generally accepted that the production/utilization of sub-bituminous coals will further increase as a result of evolving acid rain legislation, which will require further reductions of sulfur dioxide emissions—especially from the large coal fired electric utility generating stations, that constitute in excess of 80% of the domestic coal demand.

Unfortunately, because of their relatively high moisture content (generally in the range of 30–35%), the 'as delivered' heating value of sub-bituminous coals (typically in the range of 8,200 to 8,800 BTU/lb.) is significantly lower than that of bituminous coals (generally in the range of 10,500 to 12,500 BTU/lb.). Because of this lower heating value, many existing coal-fired power stations, especially those which specifically were designed to burn the higher BTU value bituminous coals, are not able to utilize sub-bituminous coals simply because of their lower BTU value which results in the inability to fire sufficient quantities of coal per unit of time to generate the required quantity of heat. This is further compounded by the long shipping distances and high transportation costs from the Wyoming Powder River Basin to the majority of the major coal fired generating facilities (major generating facilities are located near population centers). This significant shipping cost is adversely impacted by the 30% moisture content of the as-mined coal. Therefore, in spite of the forecast increase in potential demand for low sulfur coal and the recognized capability of sub-bituminous coal to satisfy the evolving sulfur emission requirements, the high moisture content of as-mined sub-bituminous coal limits its ability to respond to this opportunity.

In an effort to address this problem, it has become known to thermally dry sub-bituminous coal including using a conventional fluidized bed-type thermal dryer in an attempt to reduce the moisture content, and thereby up-grade the heating value of a sub-bituminous coal product. However, because the moisture in sub-bituminous coal is essentially entirely inherent (i.e., contained within the coal) rather than surface (occurring only on the particle surfaces), the problems and technical requirements associated with the thermal drying of sub-bituminous coal are radically different from those encountered in the thermal drying of bituminous coals, and, for this reason, the direct application of traditional bituminous coal-based thermal drying processes and experience to sub-bituminous coals is not technically appropriate. This fact has been clearly illustrated by the operating experiences of the presently operating sub-bituminous thermal dryer which, as noted above, was designed based on classical bituminous coal thermal drying experience and practice.

An advantage exists, therefore, for a method and system which will successfully, efficiently, and economically thermally dry sub-bituminous materials to raise the heating values of such materials to levels comparable to those of bituminous coals.

It is therefore an object of the present invention to provide a method and system for specifically addressing the unique drying characteristics and requirements of sub-bituminous, lignitic, and similar low-rank coals so as to raise the heating values of such materials to levels comparable to those of bituminous coals.

It is a further object of the invention to provide a method and system for drying sub-bituminous materials which integrates a number of novel and innovative sub-systems and components in order to address the particular drying characteristics and requirements of sub-bituminous materials.

Still other objects and advantages will become apparent in light of the attached drawing figure and written description of the invention presented hereinbelow.

SUMMARY OF THE INVENTION

In order to overcome the shortcomings of conventional thermal drying processes and apparatus for drying sub-bituminous materials, the present invention proposes a method and system for addressing the specific processing requirements which must be satisfied to successfully thermally dry sub-bituminous materials in order to raise the heating values of such materials. In addition, the present invention proposes a new integration of technical mechanisms to satisfy these requirements, which, in addition to being unique from an overall process perspective, incorporates several individually unique components and sub-systems.

The present invention satisfies the particular characteristics and requirements for successfully drying sub-bituminous materials by introducing an integrated method and system which provides the following advantageous features:

1. It permits the unavoidable and possibly necessary problem of size degradation naturally occurring in a dryer element during the drying of high inherent moisture low-rank coals to moisture contents in the range of 4–5% to be categorically ignored. Normally, such size degradation caused by thermal drying of the sub-bituminous materials results in an unacceptably fine size product from a perspective of market requirements. The present invention specifically resolves this degradation issue by the reconstitution (by means of binderless, high-pressure briquetting or compacting) of the dryer element product stream into a form which has enhanced physical properties and handleability characteristics over those of the un-dried feed stock materials. The ability to essentially ignore degradation means that naturally occurring thermal shock may no longer be considered a serious problem. The recognition of this fact permits utilizing a higher inlet temperature in the dryer element which decreases the quantity of gas needed to transfer the required heat to the particles, thus permitting the utilization of a smaller gas recycle fan in the gas heating system, thereby enhancing the capital and operational cost efficiency of the system.

2. It provides within different zones of a single drying element, the optimized combination of subdividing large particles by vaporizing the inherent intra-particle moisture thereof and flash drying capabilities for the finer size materials working in tandem to achieve the specific drying/degradation requirements or limitations for all size fractions of the material being processed.

3. It produces a non-water absorbing, water resistant product without relying on post-drying surface treatment. The various existing pilot and the one operating sub-bituminous dryers utilize various hydrocarbon and/or vegetative derived additives to both minimize dust emission and to seal the porous surface to eliminate the exothermic readsorption of water vapor. The elimination of these additives and the equipment utilized to apply the additives significantly reduces the operating cost of a low rank coal drying system. As a result of the moisture impervious particle surface created by the process and apparatus of the present invention, the product may therefore be cooled using water rather than air (as is required with a non-water resistant and/or water readsorbing product). The ability to water cool the product therefore becomes a fundamental prerequisite in achieving the desired final product moisture objective of 4–5%, because with sub-bituminous and other low rank coals, achieving the desired final moisture content is dependent upon heating the material to above its auto-ignition temperature, which, by definition, rules out the possibility of air cooling a product of the temperature required to achieve the desired final moisture content. In addition, the water resistant product, by definition, is not hygroscopic, which eliminates the self-heating tendency of thermally dried, and restructured, sub-bituminous coal as a result of the Latent Heat of Evaporation during condensation.

4. It results in the physical 'up ranking' of low rank coals, i.e., reducing inherent moisture content while increasing fixed carbon content and air-dry BTU value, by a series of artificial means which collectively mimic the aggregate effect resulting from geologic aging, which collectively is the result of the application of pressure and temperature over time.

5. It is a process which is applicable to low-rank materials other than sub-bituminous rank coals, i.e., lignite, peat, brown coal, etc., by alteration of several of the variable and controllable process parameters (primarily drying chamber retention time, drying chamber exit temperature, briquetting temperature, and briquetting pressure) without significant physical alteration of the existing process configuration or process equipment requirements. The process can also be controlled to produce varying moisture content products expanding the 4–5% product moisture presented in this discussion to a potential range of from 1–2% up to the as-mined moisture content.

The 4–5% total moisture product process of the present invention is presented in the following discussion because the preferred drying chamber design, degree of degradation, and drying chamber product temperature achieved, simultaneously result in the desired 4–5% product moisture and the product temperature necessary to achieve a stable, water resistant briquette at a stipulated briquetter pressure.

6. It efficiently produces a stable 4–5% moisture product, which compares extremely favorably with both the 10% product moisture currently achieved by the standard fluidized bed drying and cooling of such low-rank coal (which results in extensive degradation) and also with a similar moisture product as achieved by the simultaneous high pressure/high temperature pyrolysis of the low-rank coal (which is achieved only at a greatly increased capital and operating cost).

DESCRIPTION OF THE PREFERRED EMBODIMENT

Figure 1:
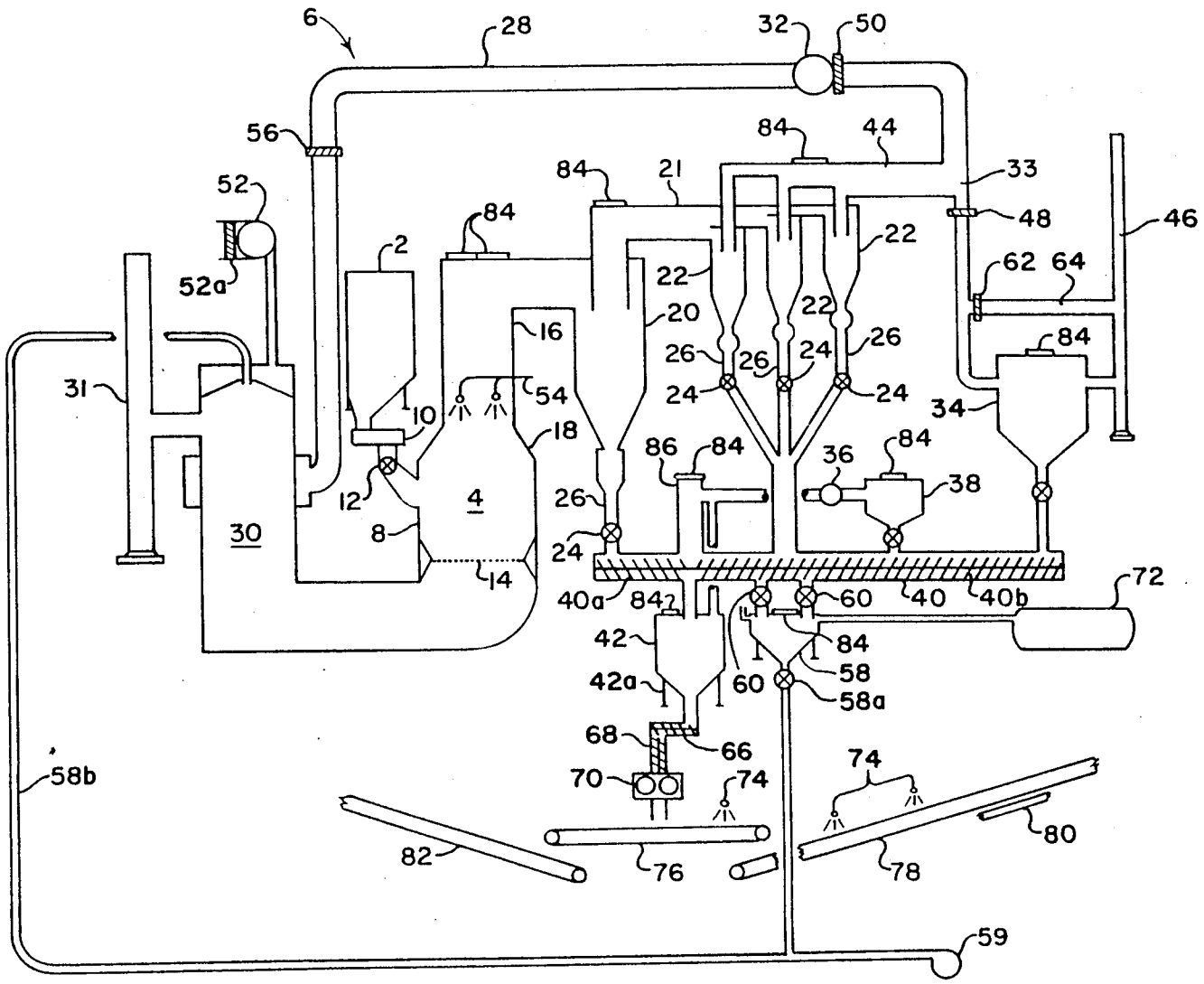
FIG. 1 is a schematic illustration depicting various integrated sub-bituminous materials processing sub-systems arranged in accordance with the present invention.

As previously noted, and as specifically distinct from bituminous coals, the moisture content for sub-bituminous coals is contained largely within the internal structure of the coal particles, rather than on the surface of the particles, as in the case with bituminous coals. With sub-bituminous coals this high inherent moisture is indicative of the low rank nature of this coal and is naturally occurring, while with bituminous coal the high moisture content, representing surface moisture, is a result of the benefication process used to reduce the inert mineral matter concentrations of the coal. Therefore, any thermal drying process for sub-bituminous coals must focus on heating both the entire particle and its internal moisture to a temperature which is sufficient to evaporate the inherent, rather than just heating the surface (or preferably, only the moisture on the particle surfaces) as is the case in thermal drying of bituminous coals.

This fundamentally different process requirement associated with the thermal drying of sub-bituminous coals, i.e., the vaporization of intra-particle inherent moisture rather than interparticle surface moisture dictates the need for a fundamentally different set of technical solutions which collectively address the specific problems of intra-particle heat transfer kinetics and water vapor migration. At the same time, it is also imperative that the system provides some means to minimize the potential for "over-drying" and partially burning the product, to the detriment of both its BTU value (decrease) and ash content (increase).

There are essentially four main factors that define the rate at which the internal portions of any particle may be heated by means of direct heat transfer from another medium. They are:

1. The temperature differential between the heating medium and the particle.

2. The size of the particle (specifically, the radial distance from the surface to center both before and after drying).

3. The specific heats of both the particle being heated and of the heating medium itself.

4. The densities of both the particle being heated and of the heating medium itself.

Of these four factors, Items 1, 3, and 4 are essentially linear in nature, while Item 2 varies inversely with the square of the particle thickness. At the same time, it must also be appreciated that the rate at which the evaporated moisture can escape from any particle is governed by the relative size of the pores within that particle, and further, that there is reasonably strong evidence to suggest that with sub-bituminous coals that the pores tend to collapse as moisture is removed, thereby making the removal of moisture from the interior of the particle relatively more difficult than from the surface but, at the same time, ultimately advantageous in reducing the propensity for moisture readsorbance by the final product. In aggregate, the above discussion suggests that, from a perspective of heat transfer kinetics and moisture removal, a small size particle is preferable to a larger one, and also that the collapse of the intra-particle porosity as a result of the drying process is of positive ultimate benefit.

One approach to achieve the desired particle size would simply be to crush or pulverize the whole of the feed stream of the process by some conventional mechanical means. However, this approach is very intensive, in terms of both the horsepower and capital inputs required.

A second and preferred approach, which is the approach of the present invention, is to utilize the naturally occurring and unavoidable degradation phenomena which is known to take place in sub-bituminous coals as a result of the collapse of the pore structure when the coal is dried (which proceeds from the surface of the particle inward) as a self-regulating means of achieving an optimum rate and magnitude of size reduction which correlates with the specific heat transfer kinetics and evaporated moisture escape requirements of any given particle at any stage of the drying process. This approach results in minimizing particle size degradation only to that level which is required to concurrently evaporate and evacuate the inherent moisture from within the particles.

The ability to advantageously utilize degradation in the system decreases the retention time necessary to dry the product. This retention time is also reduced by utilizing a higher inlet temperature which enhances the degradation of the product and increases the rate of heat transfer (more surface area). In addition, the greater temperature differential between the gas stream and the coal also results in a higher rate of heat transfer. The utilization of the higher inlet gas temperature also reduces the gas flow in the system (less gas required to transfer the same amount of heat) which, in turn, permits the utilization of a lower horsepower recycle fan as opposed to a higher horsepower fan which is required in an exclusively fluidized bed drying system that attempts to minimize degradation. Such fluidized bed system disadvantageously require greater gas volume, lower inlet temperature, longer retention time, etc.

Turning now to FIG. 1 there is shown several integrated process sub-systems and their physical interrelationship in accordance with the present invention. From reference to that figure it will be appreciated that the actual drying and heating of the high-inherent moisture sub-bituminous coal feed stock contained within feed bin 2 takes place in the specifically configured vertical drying column 4 which functions as both a subdivision through vaporization of intra-particle moisture drying/degradation system for relatively coarse materials, and as an entrainment (flash) drying and heating system for the finer size materials. The specific physical dimensions of column 4 are dependent upon the feedrate and the top size of the incoming feed in conjunction with its moisture content, and also upon the desired top size and moisture content of the product ultimately exiting column 4 (which, as will be seen, collectively define the dryer product temperature).

In the embodiment depicted in FIG. 1, column 4 is preferably sized to produce a product having a top size of nominally less than 8 mesh and a moisture content in the range of 4–5% from a feed material which contains on the order of 30–35% moisture and has a top size of something less than 1.25 inches. Column 4 is located within a circulating high-temperature gas loop 6, to be described in greater detail hereinbelow, which is maintained at a static pressure greater than atmospheric, and also at a reduced oxygen content (typically $<3\%$ V/V) relative to normal atmospheric oxygen content. This reduced oxygen content has been demonstrated to be adequate to prevent auto-ignition of the material which will occur at the required process temperatures in the presence of normal atmospheric oxygen concentrations.

The upward velocity of the heated gas stream in column 4 is so specified as to be sufficient to simultaneously:

a) subdivide through vaporization of intra-particle moisture all material in the lower portions of the column 4 which is equal to or less than the top size of the feed to reduce the structural integrity of such material, and, b) entrain in the upper portion of drying column 4 both the finer size fractions of the feed and the degraded fines produced in the lower portions of column 4.

As shown in FIG. 1, the high inherent moisture sub-bituminous coal feed (which has been crushed to a predetermined top size of something less than 1.25 inches and screened to remove any oversize material) is delivered into a lower portion 8 of the drying column 4 from the feed bin 2 via a weigh-feeder arrangement 10 and a rotary airlock 12.

Also, provided in drying column 4 is a horizontal constriction deck 14, which is located at some minimal distance below the point of feed introduction into column 4. Constriction deck 14 is preferably formed of stainless steel rods which are so spaced as to provide a nominal 7"–10" water column (W.C.) pressure drop across the deck 14 in order to provide a uniform gas flow across the whole of the column cross-section above the deck.

FIG. 1 also indicates that the preferred physical shape of column 4 is generally 'bottle-like', in that it is of a larger diameter at its lower portion 8 than at its upper portion 16. The specific purpose of this shape is to provide for the retention of the relatively larger and/or less dry fractions of the feed within a region near the base of the column (where the gas temperature and gas flow—because of temperature—will be the highest) to provide for maximum heat transfer to these relatively larger sizes of the feed stream. This provides for, and will result in, both surface and near-surface drying of these particles, and also in the size degradation of these large particles which, as noted hereinabove, is necessary to adequately and efficiently evaporate the inherent moisture from the interior portions of the large particles.

As drying/degradation of the large particles proceeds within the lower portion 8 of drying column 4 (and both particle size and mass decrease as a result of degradation and drying, respectively), the relatively dryer and/or smaller particles so produced, along with the relatively smaller particles in the feed, which as noted in the introductory section will require significantly less aggressive drying conditions than the relatively coarser fractions, are carried upward in the column (i.e., partially entrained) by the heated gas stream. The specific height to which the individual particles rise is defined as a combined function of:

1) The product of both particle size and moisture content.

2) The density of the particle.

3) The velocity and density of the gas stream.

Because of the transfer of heat from the gas stream to the particles during the drying process, the gas stream becomes cooled. This cooling results in a reduction in the volume of gas, which in turn, because the gas is moving within an enclosed system, also results in a decrease in the upward velocity of the gas in the upper region of the enlarged diameter lower portion 8 of the column 4. Because particle entrainment in the gas stream is related to both particle size and particle specific gravity (which relates to particle moisture content), and to the temperature and specific gravity of the gas (which relates to the ability of the gas to transfer heat to the particles, and thereby affect drying), those particles which ultimately migrate to the top of the large diameter lower portion 8 of the drying column 4 will be of a relatively uniform top size, specific gravity and temperature, and, therefore, will be of a much reduced and relatively uniform moisture content which is directly correlatable with the drying column gas temperature.

At the top of the lower portion 8, the column diameter is decreased as shown by an intermediate transition portion 18. Given the essentially fixed volume of gas at this transition region, this smaller diameter section of the column will result in the gas velocity in the upper portion 16 of the column 4 above the transition portion 18 becoming increased. This increased gas velocity results in the total entrainment of the uniformly dried and heated coal particles in the gas stream (as distinct from the subdivision of the particles which occurred at the lower elevations for the column), and is the mechanism by which the dried product is removed from the column 4.

The system described thus far provides the ability to retain within the drying system those large size particle fractions of the feed which require relatively aggressive size degrading drying conditions, i.e., long retention time at relatively high heat flux, in order to become dried (which will also result in some level of particle specific size degradation), and at the same time allow for the drying but not over-drying of the smaller size fractions for the feed which require less aggressive drying conditions, i.e., shorter retention time and lower heat flux as well as minimal size degradation, to produce a homogeneous product of the desired top size, temperature, and moisture content.

The specific design of the "bottle-shaped" drying column 4 in conjunction with its internal and specifically sized constriction deck 14 therefore affords the opportunity to simultaneously achieve for the first time:

1) The staged drying and size degradation, by means of subdivision through the combined influence of thermal shock and vaporization of intra-particle moisture, of a pre-defined and controlled top size of the coal material components of the feed.

2) The staged evaporation of inherent moisture from within the various size fractions of the coal materials (by both fluidized suspension and entrainment means) at varying and appropriate combinations of temperature and residence time within the system.

3) The ability to remove from the drying system a uniformly dried and consistent temperature product which has not been subjected to the adverse effects of over-drying, and therefore is of an optimal ash content and BTU value.

4) The ability to obtain a desired product moisture such as 4% to 5%, for example, at a comparatively low exhaust temperature on the order of 220° F., which minimizes the emission of waste heat to the atmosphere.

These capabilities are individually unique to drying column component, as is its ability to provide for their collective and concurrent realization.

As shown in FIG. 1, upon exiting the drying column 4, the dried particles and the transport gas stream pass through two stages of classifying cyclones, a relatively low efficiency large diameter primary cyclone 20 for removal of the relatively coarse fraction of the dried product from drying column 4, followed by several small diameter high efficiency secondary cyclones 22 for removal of the preponderance of the remaining dried product. The overflow gas stream, including suspended coal fines, from primary cyclone 20 discharges into a duct 21 which communicates with the secondary cyclone 22. Each of these cyclones are shown to have airlocks 24 on their underflow discharges 26.

A recycle duct 28, which forms part of the aforementioned high-temperature gas loop 6, receives a portion of the heated exhaust gases from cyclones 20 and 22 and recycles these exhaust gases back to a coal-fired hot gas generator or furnace 30 to be described in greater detail hereinbelow. Connected to furnace 30 is a bypass stack 31. The motive means for effecting the recycling of the exhaust gases from cyclones 20 and 22 to furnace 30 is a main fan 32 situated in the recycle duct 28. The location of the main fan in the recycle duct 28 as opposed to between the secondary cyclones 22 and a recycle/exhaust duct split 33 results in the entire system being under positive pressure. The magnitude of this static pressure is controlled and maintained to achieve a fixed and pre-defined static pressure upstream of a baghouse 34 which is sufficient to eliminate the need for an auxiliary fan for the particulate control system. A positive pressure system is utilized to accomplish the following:

1) Eliminate the possibility of air entering the process as the result of any leakage.

2) Permit the immediate identification of any leakage within the system (any leakage will result in the visible emission of particulate-laden gas).

3) Permit, through the sizing and speed control of the cyclone airlocks 26 and by means of a low volume fan 36 and dust collector 38, each to be described below, the bleeding of a controlled quantity of combustion gases into a collecting screw 40 and briquetter surge bin 42, also to be described below, to thereby inert that part of the system. Due to potential condensation and baghouse pre-heating requirements, it is anticipated that the dust collector 38 will be a small cyclonic separator with the particle deficient cyclone overflow being directed to the baghouse 34 inlet.

The overflow stream from the secondary cyclones 22 discharges into a common exhaust/recycle duct 44. A large portion (on the order of 40–60%) of this secondary cyclone exhaust gas stream is recirculated, by means of the main recycle fan 32, back to the integrated hot gas generator section/drying process section to be discussed subsequently, with the volume of actual exhaust gas discharged to the atmosphere from the process through exhaust stack 46 being equal to only the sum of the products of combustion of the coal-fired hot gas generator 30 plus the evaporative load i.e., that quantity of moisture which was evaporated from the feed material by the heated gas.

The static pressures within the drying system are maintained constant, i.e., they will not migrate within the gas "loop", by an automatic static pressure stabilization damper 48 located downstream from the recycle/exhaust split 33 and upstream of the baghouse 34. This damper 48 operates as a function of the pre-determined static pressure in the gas 'loop' necessary to maintain a static pressure sufficient to operate the baghouse 34, and, as a result, maintains that static pressure but does not influence the exhaust gas flow through exhaust stack 46. As stated previously, exhaust gas flow equals the sum of the combustion products and the evaporative load and it is not influenced by the setting of damper 48.

The degree of gas recirculation within the gas "loop" is maintained either with the recycle fan 32 and an inlet damper 50 (as shown) or with a variable speed fan to : (1) maintain the inert atmosphere of the system, (2) provide both the optimum vaporization and entrainment velocities within the drying column 4; and (3) set the inlet temperature to achieve a desired intra-particle moisture vaporization temperature in column 4 in order to optimize the degree of degradation (thermal shock) for the desired product moisture while still transferring the correct amount of heat necessary to achieve the desired product moisture.

The specific configuration and operating logic of this internal gas management system (which specifically provides for the inerting of not only the feed material dryer system itself, but also of the downstream dried product collection and restructuring systems (to be later described), is in itself, a unique element of the present invention.

From a process control perspective, the temperature of the secondary cyclone exhaust gas stream serves as the primary control parameter for the balance of the system temperature(s). This system-wide temperature control is achieved by varying the heat input to the system, provided by the pulverized-coal fired furnace 30, by varying its firing rate, which in turn defines the quantity of evaporative load necessary to achieve and maintain the desired and pre-defined secondary cyclone exhaust gas temperature. Based on a fixed feedrate to the dryer column 4, the furnace 30 heat input will vary to achieve a constant secondary cyclone 22 exit temperature. Based on a fixed gas flow and coal feed characteristics, the set exhaust temperature will correspond to a fixed dried product temperature. Based on the degradation within the system, this dried product temperature corresponds to both a desired product moisture and the temperature necessary to achieve a stable, water resistant briquette at a specified briquetting temperature and pressure. The recycle gas stream is blended with both the combustion air supplied to furnace 30 via combustion air fan 52 (to control peak flame temperature, and therefore $NO_x$ emissions) and with the hot gases produced by the furnace to thus produce a combined (and inert) hot gas stream discharging into the base of the drying column 4 below the earlier described constriction deck 14.

The fuel consumed in the integrated system of the present invention consists of the fines supplied from the baghouse and secondary cyclones via collecting screw 40 as well as from suspended coal fines contained in the recycle gas stream (secondary cyclone overflow). The secondary cyclone efficiency is set to minimize the amount of coal fines in the recycle duct 28 so that this portion of the fuel source represents less than 20% of the required heat input. Due to the uncontrolled quantitative nature of this portion of the total fuel supply, it is impossible to set the combustion air quantity supplied from combustion air fan 52 as a function of the controlled portion of the fuel supply. As a result, the combustion air supply from fan 52 is automatically varied as a function of the oxygen content of the hot gas stream below the constriction deck 14.

The furnace 30 must be operated during start-up and shut down, both to supply the necessary heat input to the system to achieve the desired gas temperatures (and therefore system pressure drop(s), gas volumes, and gas flows), and also to provide the means for "inerting" the entire system gas stream (by the previously discussed means of recirculating oxygen deficient flue gas within the system), prior to the introduction of coal. At the same time, during these "no feed" periods, it is necessary to provide some type of "heat-sink" for the thermal energy generated by the furnace 30, or else the system temperature, and therefore the above-noted system parameters of pressure drop(s), gas volumes, and gas flows, would be uncontrollable. It is also necessary to provide an artificial pressure drop in the gas "loop" during start-up and shutdown that would correspond to the fluidized bed pressure drop that is experienced when coal is present in the drying column 4 of the system. By providing both an artificial "heat sink" and an artificial pressure drop, it is feasible to simulate the dryer column operation with no coal present in the system.

These requirements are collectively satisfied by an atomized water-spray system 54 which supplies a controllable "artificial" evaporative load (atomized water) to the drying column and an artificial load damper 56 located in the recycle duct 28. The specific quantity of water supplied is controlled, and thereby also controlling the temperatures(s) and related gas flow parameters throughout the entire system, based upon the temperature of the secondary cyclone 22 exhaust gas stream. During these periods artificial load damper 56 is utilized as opposed to the recycle fan inlet damper 50 to permit maintaining a constant pressure/gas-flow through the gas "loop" (inlet dampers are designed to save energy by "turning" the gas flow into the direction of rotation of the fan resulting in the gas flow not being directly proportional to the fan static pressure).

The atomized water sprays 54 are proportionally controlled and are designed to provide, at a minimum, 50% of the design evaporative load of the dryer column 4. This is sufficient to obtain and maintain the inertness of the gas during start-up and shutdown without having coal present in the system as a heat sink. The atomized water sprays 54 also serve as a "backup" control to the exhaust temperature control (controlled by constriction deck 14 inlet temperature and/or heat input). In this mode, the atomized water sprays 54 are proportionally introduced to the drying column 4 if the secondary cyclone exhaust temperature exceeds a pre-determined band above the setpoint.

The utilization of such a water addition system 54 and artificial load damper 56 to control not only gas temperature, but additionally the above noted critical system parameters of pressure drop(s), gas flow(s), and gas volume(s) throughout the entire system, both during start-up/shut-down sequence(s) and during normal system operation, is, in itself, a unique element of the total process system.

The exhaust gas fraction of the overflow gas stream from the secondary classifying cyclones 22 will contain concentrations of very fine particulate material (fine dry coal) which are in excess of allowable emission levels, and therefore, additional particulate emission control facilities are required to enable discharge of this gas stream to the atmosphere in compliance with applicable environmental requirements.

As is shown in FIG. 1, the aforesaid baghouse-type dust collector 34 is specifically utilized for this purpose. The baghouse-type facility is chosen over the more commonly employed "wet scrubber" system for several important and advantageous reasons.

First, to achieve the same level of emission control efficiency, the pressure drop across the baghouse system is significantly less (typically 1-3 inches W.C.) than is a wet scrubber system (typically 30-35 inches W.C.). Especially in the case of a positive pressure drying system, this reduced pressure drop directly translates into major savings in terms of both capital and operating costs.

Second, and of more fundamental importance, is that the particulate material collected by the baghouse 34, i.e., very fine dry coal, is generally of a size consist and quality which is suitable for direct utilization as a fuel source in the coal-fired furnace 30 without additional pulverization, provided that means are provided to limit the amount of baghouse material contained in the total furnace fuel supply stream to thereby mitigate the adverse consequences of excessive recirculation of combustion ash materials produced by the furnace upon overall furnace performance. This requirement is satisfied by the product collecting screw conveyor 40 which receives the products from the primary cyclone 20, secondary cyclone 22, and the baghouse 34. Product collecting screw conveyor 40 includes a first section 40A having a flight which spirals in a first direction for carrying the relatively coarse fraction of the dried product from primary cyclone 20 to briquetter surge bin 42, and a second section 40B having a flight which spirals in a second direction, opposite to said first direction, for carrying the fines from secondary cyclones 22 and baghouse 34 to surge bin 42 and/or furnace fuel bin 58.

The product collecting screw conveyor 40 further includes metering means in the form of valves 60 by which the quantity of baghouse material which is utilized as fuel can be regulated (and supplemented) by secondary cyclone material (which is also of suitable quality and size consist for direct firing into the furnace). At the same time, the valves 60 also serve as means for diverting a portion of the baghouse product from the furnace fuel producing process for inclusion in the final product forming process whereby a portion of the baghouse product is controllably blended into the surge bin 42 of the restructuring system (where it becomes incorporated into the final product).

Fuel material for furnace 30 is metered from fuel bin 58 via a controllable rotary feeder **58*a* which dispenses pulverized fuel into pulverized fuel transport line 58*b*. Upon entering fuel transport line 58*b*, the fuel is blown by transport air blower 59 into furnace 30**.

Collectively, the fuel supply system of the present invention, which provides a means for managing the problem of "build-up" of combustion ash materials within the internally utilized fuel source, i.e., fuel bin 58, by enabling the establishment of a controlled equilibrium state in which a portion of the combustion ash (which is equal to the quantity of ash produced on a real time basis) is incorporated into the final product stream, is, in itself, a unique element of this system.

Furthermore, in the specific application of the total process system of the present invention to sub-bituminous coals (which by nature contain relatively high concentrations of calcium and magnesium bearing minerals), this fuel supply sub-system, in combination with the recycle gas sub-system, retains approximately 40-60% of the process gas volume within the system (as distinct from a "once-through" which discharges the whole of the process gas stream to the atmosphere), and results in the total circulating gas stream having sufficiently high concentrations of calcitic and dolomitic materials that—in conjunction with the inherently low sulfur content of the coal itself—becomes a 'self scrubbing' system with respect to sulfur dioxide emissions, and will not require installation of additional sulfur dioxide emission control facilities.

The specific details associated with the installation of the baghouse 34 in the present invention are shown in FIG. 1, which also shows the associated configuration of the exhaust gas system overall. From this illustration, it is evident that the exhaust gas stream contains two dampers, the static pressure stabilization damper 48, and the baghouse bypass damper 62.

The static pressure stabilization damper 48 is, in itself, a critical component of the overall process system of the present invention, irrespective of the baghouse 34. That is to say, damper 48 is the mechanism by which the static pressure (s) will be controlled and held stable throughout the balance of the entire system. This is absolutely vital in order to control the individual processes themselves, i.e., in achieving and/or maintaining design static pressure (s).

The specific location and process control capability and logic associated with the static pressure stabilization damper 48 is, in itself, an individually innovative and unique component of the overall system of the present invention which is potentially applicable to thermal drying facilities outside of the present context.

In respect to the baghouse bypass damper 62, it is noted that, in contrast to conventional practice (which provides for bypassing the exhaust gas stream within the baghouse enclosure), the present system incorporates a damper 62 and separate ductwork 64 to physically bypass the whole of the exhaust gas stream entirely around the entire baghouse 34 facility. This configuration is designed to be utilized during start-up with either gas or oil as fuel, whose combustion products, along with the partial evaporative load being supplied by the water sprays 54, will collectively result in a nil particulate loading in the exhaust gas stream.

The exhaust gas generated during start-up may be at a temperature near or below its dew point; consequently, it must be bypassed entirely around the baghouse with the bypass damper 62 open in order to prevent condensation of moisture within the baghouse 34 and pluggage of the filter media therein. Once the system temperatures reach the desired operating level, i.e., above the dew point and hence not subject to condensation, the baghouse bypass damper 62 will close and the whole of the exhaust gas stream will be routed through the baghouse 34. In addition, the utilization of the baghouse bypass damper 62 during initial start-up (when fans are turned on) minimizes the potential occurrence of spontaneous combustion of any coal fines retained in the baghouse from the previous operation. These problems are not and cannot be resolved by the internal bypass systems of conventional baghouses.

As was noted in both the introductory section and also in the foregoing discussion of the thermal drying section of the process, the fundamental objective of the present process is to provide for the thermal drying of sub-bituminous coals to fairly low moisture contents (range of 4 to 5% or less) to produce a marketable product having a much reduced moisture content and enhanced calorific value.

Experience has shown that the achievement of the desired final moisture content by means of drying in a direct heat exchange relationship with a hot gas stream unavoidably results, and is, in fact, because of heat transfer kinetics and evaporated moisture removal requirements, dependent upon reducing the size consist of the material during the drying process to a level which is unacceptable in the marketplace.

However, as will become apparent, that within the novel method and system of the present invention, the hot, degraded, normally unacceptable, low moisture sub-bituminous coal fines of about minus 8 mesh in size that will be produced by such a drying process are ideally suitable for restructuring (by means of high pressure roll briquetting, or in some applications compacting, without the use of any supplementary binder materials) into a marketable size product having favorable handleability characteristics, reduced moisture content, and enhanced BTU value.

As a result of a detailed series of tests, it has been demonstrated that this reconstitution by binderless high pressure roll briquetting according to the present invention is dependent upon seven principle factors:

1) The temperature of the material.

2) The size consist of the material.

3) The 'de-gassification' and pre-compaction of the fines prior to actual restructuring.

4) The compressive pressure applied to the hot fines during the restructuring operation.

5) Maintaining an oxygen deficient atmosphere throughout the 'degassifying', pre-compacting, and restructuring phases of the process.

6) Providing a means for the controlled cooling of the hot restructured product.

7) Making certain that the material being restructured contains a minimal amount of 'furnace ash' materials, Given satisfaction of these criteria, the fine size thermally dried sub-bituminous coal can be successfully restructured by the unique system and method of the present invention into a physically competent and water resistant final briquetted product.

The following discussion outlines the necessary equipment and the physical arrangement thereof that is required to satisfy the above criteria. Also presented is a general definition of the several coal-specific process parameters (temperature and size consist of the material, and compressive pressure applied by the briquetting/compacting press) which must be collectively satisfied.

1) Temperature of the Material

The temperature of the dried fine material feeding the briquetting section of the process is controlled by regulating the temperature of the secondary cyclone exit gas, which as previously noted, is determined by the heat input to the system supplied by the furnace 30, the total evaporative load in the drying column 4, i.e., the sum of the evaporative load supplied by the coal feed and/or the evaporative load supplied by the water spray system, and the heat retained by the dried product.

Relative to the specific temperature required for optimal briquette quality, testwork has shown that dried sub-bituminous fines can be formed into briquettes by the method and system of the present invention at temperatures as low as ambient (room temperature), but that the briquettes produced under these conditions are not water resistant. Water resistance and overall briquette quality were noted to improve significantly as temperature is increased form ambient to about 160 to 180° F. Briquettes formed at approximately 170° F. exhibited a high degree of physical competence and water resistance. It has been also noted, however, that briquette quality began to decline if the material was heated to a temperature in excess of 220° F. These temperature limitations were determined on a specific sub-bituminous coal and will vary as a function of the specific coal and the size consist.

2) Feed Size Consist

The size consist of the feed to the briquetting section of the process is directly related to the level of size degradation which occurs during the drying process—especially in the lower level 8 of the drying column 4, and is therefore directly related to the moisture content of the dryer product. Because the moisture content of the dryer product stream will be fixed, this element of the process becomes eliminated as a process variable.

Relative to the optimum feed material size distribution, optimum results are achieved when the nominal top size of the feed is in the range of 8 mesh, and also when the feed contains not appreciably more than 35% minus 325 mesh material.

3) De-Gassification and Pre-Compaction

As shown in FIG. 1, the briquetting system employs two stages of de-gassification/pre-compaction auger units 66 and 68 which concurrently provide for the initial densification of the dried material prior to its being fed to the briquetting press 70. These auger units 66 and 68 are driven by torque controlled drives which provide a self-regulating means of controlling the volumetric feed rate to the briquetting press 70. In addition, FIG. 1 shows the mechanism by which the inert gas that is liberated from the material during the pre-compaction process is treated by means of the previously mentioned small volume fan 36 and dust collector 38, from which the captured dust is re-introduced into the fuel bin side of the secondary classifying cyclone/baghouse product collection screw conveyor 40.

4) Compressive Pressure

The actual compressive pressure required to convert the dry nominal minus 8 mesh hot fines into restructured product is provided by high-pressure roll type briquetting/compacting machines 70 which are capable of applying compressive pressures in the range of 30,000–50,000 lbs/linear inch of roll face. Because the generation of pressure within a roll briquetting press is dependent upon the volume of material being compressed between the counter-rotating rolls at any point in time, and is also directly correlatable with the electric current load (amperes) being applied by the electric motor which powers the rolls, compressive pressure is frequently controlled by varying the rotational speed of the rolls. Based upon this relationship, compressive pressure during restructuring will be controlled by means of a variable speed motor drive unit (not illustrated) for the briquetting/compacting machine 70 which is installed in a controlled arrangement based upon the electrical current demand of this motor as compared with pre-defined setpoint current.

Relative to the specific pressure required for optimal briquette formation, testwork has shown that while the dried sub-bituminous coal material may be pressed into briquettes at pressures as low as 10,000 psi, that the briquettes produced under these conditions were structurally weak and exhibited poor water resistance. However, it was also demonstrated that these same coal materials can be pressed into substantially better quality briquettes when the compression is increased to 30,000 psi; and continued to show additional and meaningful improvements in structural integrity and water resistance as the compressive pressure was increased to the range of 50,000 psi, but that little additional improvement in quality was observed when the compressive pressure was increased to above 50,000 psi.

5) Maintenance of an Oxygen Deficient Atmosphere

It is known and demonstrated fact that sub-bituminous coal fines which have been thermally dried to moisture content(s) in the range of 10% or less (substantially below the inherent moisture content of un-dried sub-bituminous coal materials but above the preferred level of 4–5% achievable by the present invention) are highly susceptible to rapid spontaneous ignition approaching spontaneous explosion when exposed to normal atmospheric concentrations of oxygen (22–25% by weight) even at ambient temperature conditions. Furthermore, this level of reactivity is significantly increased to well beyond tolerable safe levels as the temperature of the material is increased to the 170° F.+ level required for efficient briquette formation. For this reason, it is necessary that the entire portion of the process system containing the hot and dry fine coal must be maintained under inert (oxygen deficient) conditions.

As is shown in FIG. 1, and addressed in previous sections herein, this requirement is met by maintaining an overall positive static pressure throughout the process (via the static pressure stabilization damper 48 and the location of the recycle fan 32), and by maintaining the entire system under an inert gas environment via controlled 'leakage' of inert gas from the dryer section through the airlocks 24 of the primary 20 and secondary cyclones 22), and is supplemented by the introduction of carbon dioxide from a $CO_2$ storage bin 58.

6) Cooling of the Briquetted Product

The temperature of the briquetted/compacted product as discharged from the briquetting press 70 will be slightly higher than the temperature of the incoming hot dry fine coal feed as a result of the energy expended on the briquette by the high pressure briquetting process itself. While the exposed surface area of the material in the restructured form is vastly reduced over that of the minus 8 mesh feed material which advantageously results in a reduction in the propensity for it to undergo spontaneous ignition, it has nonetheless been demonstrated that some form of post-restructuring cooling is necessary to prevent spontaneous combustion and to make the product handleable under normal production conditions.

As seen in FIG. 1, this cooling is achieved by means of a system which applies a controlled quantity of water to the surface(s) of the freshly formed product to reduce the temperature of this product by means of evaporative cooling. This cooling water will be applied to the briquettes by means of water spray heads 74 which are located above two product stream conveyor belts, i.e., a reversible variable speed belt 76 and the product belt 78.

The quantity of cooling water applied to the product is balanced with the total quantity of heat which must be removed in order to achieve the desired aggregate product stream temperature which will prohibit spontaneous combustion and provide handleability. The quantity of applied cooling water will be determined by both the temperature of the product, i.e., feed temperature to the press 70 plus heat added as a result of compaction and the total quantity of product being produced as measured by a belt scale 80 on the product belt 76. These two parameters are integrated, and thus control of the volume of spray water applied to the product by the water spray heads 74 is such that cooling is efficiently achieved by evaporation rather than by inefficient saturation with excess water which results in water effluent treatment requirements.

As mentioned previously, belt 76 is reversible and may convey material to product belt 78. However, belt 76 may also convey material to a recycle belt 82 which is used during startup and shutdown of the overall system. Recycle belt 82 may convey material to a truck bin, a silo, and/or drying column feed bin 2.

Although for reasons elaborated upon hereinabove which explain why the dried product of the present invention is highly resistant to explosion, as a safety precaution, explosion doors 84 are provided at those points in the system which are most susceptible to explosion caused by spontaneous ignition of the dried product, i.e., the top of drying column 4, duct 21, duct 44, the top of fuel bin 58, the top of a column 86 which forms part of the low volume fan 36/dust collector 38 "inerting system", the briquetter surge bin 42, dust collector 38, and baghouse 34.

7) Maintaining Minimum Quantities of Combustion Ash Materials in the Feed to the Briquetting System Sub-bituminous coals typically contain a much higher concentration of alkaline materials, e.g., calcium, magnesium, potassium, and sodium-based materials, than do bituminous coals. As a result, the combustion-derived ash fractions of sub-bituminous coals typically contain far more divalent alkaline materials, e.g., oxides of calcium and magnesium, than do bituminous coals (25 to 30+% versus 2 to 6%). It is also known that during the normal combustion process, the alkaline minerals in the coal are typically converted into oxides, i.e., CaO, MgO, $Na_2O$, and $K_2O$, which remain in the residual ash. Because both CaO and MgO are quite hygroscopic and react exothermally with water to form hydrates, the presence of excess quantities of combustion ash in the material being restructured is detrimental to ultimate briquette quality, specifically in terms of water resistance. This fact has been demonstrated by testwork, which shows that:

a. essentially pure minus 8 mesh thermally dried sub-bituminous coal fines which contained on the order of 6–7% ash on a dry basis (with such ash containing, based on the standard mineral ash analyses, on the order of 26% CaO, 5% MgO, 3% $Na_2O$, and 0.3% $K_2O$, of which none has been calcined as a result of combustion) can be pressed into physically component and water resistant briquettes; but that, b. briquettes made from materials having a similar mineral ash analysis (i.e., 26% CaO, 5% MgO, 2% $Na_2O$, and 0.3% $K_2O$), but which had a dry ash content in the range of 8–9% (i.e., contained about 3% combustion ash materials, based on an ash content in the combustion ash fraction of 75–85%) while of approximately equal physical strength, were not water resistant to any significant extent.

The negative effects of this fact are addressed and resolved by:

a. The gas recirculation system which limits the quantity of exhaust gas to that required to remove the combustion products generated by the furnace plus the evaporative load generated by drying the coal. This results in high thermal efficiency which equates to minimal fuel requirements—and therefore—minimum ash production, and b. The two-stage cyclone and baghouse system previously described, along with the briquetting system itself.

The high thermal efficiency of the system results in the production of a minimal quantity of ash materials relative to the quantity of dried product produced, while the cyclone/baghouse system provides a means to limit the amount of combustion ash material which is contained in the product stream to level equal to the rate of ash generation. It is estimated that this equilibrium ash concentration in the product will only amount to about 10% of the level which has been shown to be detrimental to the briquetted product quality, and is therefore not a problem.

Within the product restructuring process system, the output rate of the briquetting/compacting section becomes the determining factor relative to the throughput capacity of the balance of the process. The capacity of this section is a function of the size of the briquettes and/or compact thickness (which is essentially fixed), the number of briquetting/compacting machines 70 in use, the size of the briquetter/compactor units, and the rotational speed of the rolls of the individual machines. Relative to the throughput capacity of each machine, the roll speed is variable, and does provide a small range in the machine's throughput capacity while still producing an acceptable quality product. Within the overall system of the present invention, however, the rate at which the sized raw feed is supplied from the feed bin 2 into the drying chamber 4, and, therefore, the overall rate of the drying/degradation process within the system, will be controlled based upon the quantity of material contained in the briquetter surge bin 42 (as indicated by bin load cells 42*a*) relative to the number of briquetting/compacting machines 70 in actual operation.

During start-up or shutdown, the briquetters/compactors 70 will be either brought on or dropped off-line in a series of sequential steps. As an example, the dryer 4 could be brought up to a heat input representing one-third of the dryer capacity using the previously described atomized water sprays 54 and artificial load damper 56. At this point, the whole of the system would be inert, coal feed could be introduced at one-third of the design tonnage, and the quantity of artificial evaporative load and system pressure drop collectively imposed by the atomized water sprays 54 and the artificial load damper 56 correspondingly reduced. Once a predetermined quantity of degraded, dried, and properly heated fine coal had been accumulated in the briquetter surge bin 42 (as indicated by the briquetter surge bin load cells 42*a*), one-third of the briquetter/compactors would then be energized. Until briquetter/compactors rolls become heated up, some of the product may be of a relatively poor quality, and may need to be either recirculated or disposed. This is accomplished by controlling the direction of material travel on the reversible variable speed belt conveyor and operation of recycle belt 82.

Simultaneously with this bringing on-line of the first section of the product restructuring process, the furnace heat input would be increased and the atomized water sprays 54 and artificial load damper 56 re-energized proportionally until the furnace heat input corresponded to two-thirds of the design load. At this stage, the coal feed rate from the feed bin 2 to the drying chamber 4 would again be increased, the atomized water spray 54 and artificial load damper 56 influences proportionally decreased (thus maintaining system temperature and gas stream 10 balance), and additional briquetters/compactors 70 energized. This process of increasing heat input, balancing artificial versus actual evaporative load and pressure drop, and bringing on additional briquetter/compactor units 70 would be repeated until the overall system was at full load. Once normal full (design) load operating conditions were achieved, the weight of material in the briquetter surge bin 42 would be maintained at the design level by controlling the dryer feed rate by means of the weighfeeder 10.

Then, during normal production, the actual drying system is controlled by regulating the heat input (fuel consumption rate) as a function of a pre-set secondary cyclone exhaust gas temperature. This control system will automatically respond to small changes in the feed rate to the process which will become manifest as corresponding fluctuation in the quantity of material contained in the briquetter surge bin 42 as indicated by the briquetter surge bin load cells 42*a*. Any sudden increase in the exhaust temperature that could not be adequately/quickly reduced by the controlled decrease in fuel rate would result in the automatic controlled energizing of the atomized water sprays 54. Additional automatic controls in the system include:

1) The gas flow within the "gas loop" being controlled by maintaining a pre-set pressure drop across the secondary cyclones by varying the recycle fan inlet damper 50.

2) The combustion air being controlled by maintaining a pre-set oxygen concentration at the constriction deck inlet by varying the combustion air fan damper 52*a*.

Shutdown of the system will be accomplished by a procedure which is essentially the reverse of the start-up sequence, i.e., by dropping briquetters 70 off-line, reducing material feed rate to the system at a rate proportional to the weight of material contained in the briquetter surge bin 42 and the number of briquetters on-line, and balancing or otherwise controlling the system gas temperature and drying chamber pressure drop by means of the atomized water sprays 54 and artificial load damper 56.

The overall process system as described above is, in itself, reflective of a totally new and different approach which is specifically applicable to satisfying those criteria which experience has shown must be satisfied in order to convert high inherent moisture (30–35%), low BTU value (8,200–8,800 BTU/lb) sub-bituminous coals, and the like, into a high BTU (11,000– 11,500 BTU/lb) low moisture (approximately 5–8%) product which at the same time has acceptable handleability characteristics in the context of the current marketplace and user infra-structure system.

In addition to its overall and singularly unique approach and applicability to this specific requirement, this system also incorporates, a number of new and individually unique component sub-systems and processes some of which are capsulized below, which themselves have individual application(s) and/or capabilities beyond those outlined herein.

1) A unique drying chamber means which incorporates a specifically designed constriction deck and unique drying chamber geometry for particle subdivision through vaporization of intra-particle moisture for concurrent degradation/drying and entrainment (flash) drying of sub-bituminous coals.

2) A unique process control system means which employs both water addition means to apply an artificial and controllable evaporative load to/in the overall process system, and damper means for the specific purposes(s) of controlling and stabilizing: a. temperature(s), b. pressure drop(s), and c. gas volume(s) throughout the entire system. In addition, a unique control system which varies the dryer feedrate as a function of briquetter capacity/briquetter surge bin level with the dryer automatically responding to the resultant small variation in evaporative load.

3) A unique internal fuel supply system for supplying a properly sized pulverized fuel to the internal hot gas generator which does not require the specific installation of internal pulverization facilities but which utilize elements of the product recovery and emission control sub-systems in a closed-loop configuration, and at the same time, allows for the control and limiting of the concentration of combustion ash materials which might otherwise adversely impact the performance of the pulverized coal-fired hot gas generator and/or the ability of the product to be restructured such that neither of these elements of the process are adversely impacted.

4) An internal air and gas handling system which provides maximum control flexibility and at the same time employs a minimum number of process components and driven/moving parts. In addition, this internal gas handling system also provides the mechanism for the necessary inerting of the whole of the drying/degradation and restructuring portions of the process, via oxygen deficient process gas until that point in the process system at which the restructured and up-ranked product is water cooled (to auto-ignition level).

5) A unique and innovative means for cooling of the freshly formed restructured product which employs controlled water addition for controlled cooling by evaporation which in turn provides a mechanism of achieving final product moisture levels which are lower than those achievable by the presently employed fluidized air-cooling means.

While the present invention has been described in connection with the preferred embodiment of the attached figure, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A method of increasing the BTU value of carbonaceous particulate fuel material by reducing the inherent moisture content thereof, said method comprising the steps of:

introducing a pressurized heated gas stream into an inlet of a chamber and introducing a feed of carbonaceous particulate fuel material into said chamber, said chamber having a sub-atmospheric oxygen content; and heating said particulate material using said pressurized heated gas stream introduced into said chamber until such time that particles introduced into said chamber achieve a reduced inherent moisture content and an attendant particle size reduction essentially at or below a predetermined maximum particle size and a predetermined maximum moisture content whereat the velocity of said heated pressurized gas stream is sufficient to entrain in said gas stream and carry from an outlet of said chamber of the fuel particles introduced into said chamber.

2. The method of claim 1 wherein said step of heating using said pressurized heated gas stream includes:

continuously subdividing relatively larger sized fractions of said particulate material by thermal shock and the rapid vaporizing of the inherent intra-particle moisture thereof in order to continuously produce size-degraded particles of said relatively larger sized fractions which are entrainable in said gas stream;

continuously entraining in said gas stream both particles of relatively finer sized fractions of said particulate material introduced into said chamber and said size-degraded particles of said relatively larger sized fractions.

3. The method of claim 1 further comprising recycling said pressurized heated gas stream through said chamber.

4. The method of claim 1 further comprising, subsequent to being carried from said outlet of said chamber, separating a substantial portion of the particles from said gas stream.

5. The method of claim 4 further comprising recombining the particles separated from said gas stream into a recombined fuel product of reduced moisture content and increased BTU value relative to said feed of carbonaceous particulate fuel material.

6. The method of claim 5 further comprising performing said recombining without the use of binder materials.

7. The method of claim 1 wherein said predetermined maximum moisture content is approximately 8 percent or less by particle weight.

8. The method of claim 1 wherein said predetermined maximum moisture content is in the range of 4 to 5 percent by particle weight.

9. The method of claim 1 wherein the BTU value of said carbonaceous fuel material is increased from a value of less than 11,000 BTU/lb. to a value of at least 11,000 BTU/lb.

10. A combined method of increasing the BTU value of carbonaceous particulate fuel material by reducing inherent content thereof and recombining of such particulate material into a fuel product, said method comprising the steps of:

introducing a pressurized heated gas stream into an inlet of a chamber and introducing a feed of carbonaceous particulate fuel material into said chamber, said chamber having a sub-atmospheric oxygen content;

heating said particulate material using said pressurized heated gas stream introduced into said chamber until such time that particles introduced into said chamber achieve a reduced inherent moisture content and an attendant particle size reduction essentially at or below a predetermined maximum particle size and a predetermined maximum moisture content whereat the velocity of said heated pressurized gas stream is sufficient to entrain in said gas stream and carry from an outlet of said chamber of the fuel particles introduced into said chamber;

subsequent to being carried from said second end of said chamber, separating a substantial portion of the particles from said gas stream; and recombining the particles separated from said gas stream into a fuel product of reduced moisture content and increased BTU value relative to said feed of carbonaceous particulate fuel material.

11. The method of claim 10 further comprising performing said recombining without the use of binder materials.

12. The method of claim 10 wherein said step of heating and drying using said pressurized heated gas stream includes:

continuously subdividing relatively larger sized fractions of said particulate material by thermal shock and vaporizing the inherent intra-particle moisture thereof in order to continuously produce size-degraded particles of said relatively larger sized fractions which are entrainable in said gas stream;

continuously entraining in said gas stream both particles of relatively finer sized fractions of said particulate material introduced into said chamber and said size-degraded particles of said relatively larger sized fractions.

13. A system for increasing the BTU value of carbonaceous particulate fuel material be reducing the moisture content thereof, said system comprising, in combination:

means for containing a feed stock of said carbonaceous particulate fuel material, and means for heating said particulate material;

means for delivering a feed of said particulate material from said means for containing to said means for heating, said means for heating having a sub-atmospheric oxygen content; and means for supplying a heated pressurized gas stream to an inlet of said means for heating, said heated pressurized gas stream heating said particulate material until such time that particles delivered to said means for heating achieve a particle size and a reduced inherent moisture content essentially at or below a predetermined maximum particle size and a predetermined maximum moisture content whereat the velocity of said heated pressurized gas stream is sufficient to entrain in said gas stream and carry from an outlet of said means for heating the particles delivered to said means for heating.

14. The system of claim 13 wherein said means for heating comprises a vertical chamber having a lower portion, an intermediate portion and an upper portion;

said lower portion including said inlet and having a first horizontal cross-sectional area, said upper portion including said outlet and having a second horizontal cross-sectional area less than said first horizontal cross-sectional area, said intermediate portion having a horizontal cross-sectional area gradually decreasing in size from said first horizontal cross-sectional area to said second horizontal cross-sectional area.

15. The system of claim 14 wherein, in said lower portion, said heated pressurized gas stream continuously subdivides relatively larger sized fractions of said particulate material by thermal shock and vaporizing the inherent intra-particle moisture thereof in order to produce size-degraded particles of said relatively larger sized fractions which are entrainable in said gas stream; and in said intermediate and upper portions, said heated pressurized gas stream continuously entrains both particles of relatively finer sized fractions of said particulate material and said size-degraded particles of said relatively larger sized fractions.

16. The system of claim 15 wherein said lower portion includes means for inducing a predetermined pressure drop in said heated pressurized gas stream as said gas stream passes thereacross, said means for inducing providing a uniform gas flow across the entirety of said chamber above said means for inducing.

17. The system of claim 16 wherein said predetermined pressure drop is in the range of 7 inches to 10 inches water column pressure drop.

18. The system of claim 17 wherein said means for inducing comprise a deck formed of spaced stainless steel rods.

19. The system of claim 13 further comprising means for separating from said gas stream a substantial portion of the particles entrained therein subsequent to said particles being carried from said outlet.

20. The system of claim 19 further comprising means for recombining the particles separated from said gas stream into a fuel product of reduced moisture content and increased BTU value relative to said feed of particulate material.

21. The system of claim 20 wherein said means for recombining recombines the particles separated from said gas stream without the use of binder materials.

22. A system for increasing the BTU value of carbonaceous particulate fuel material by reducing the inherent moisture content thereof and for recombining of such particulate material into a fuel product, said system comprising, in combination:

means for containing a feed stock of said carbonaceous particulate fuel material, and means for heating said particulate material;

means for delivering a feed of said particulate material from said means for containing to said means for heating, said means for heating having a sub-atmospheric oxygen content;

means for supplying a heated pressurized gas stream to an inlet of said means for heating, said heated pressurized gas stream heating said particulate material until such time that all particles introduced into said means for heating achieve a particle size and an inherent moisture content essentially at or below a predetermined maximum particle size and a predetermined maximum moisture content whereat the velocity of said heated pressurized gas stream is sufficient to entrain in said gas stream and carry from an outlet of said means for heating particles introduced into said means for heating;

means for separating from said gas stream a substantial portion of the particles entrained therein subsequent to said particles being carried from outlet; and means for recombining the particles separated from said gas stream into recombined fuel product of reduced moisture content and increased BTU value relative to said feed of particulate material.

23. The system of claim 22 wherein said means for recombining recombines the particles separated from said gas stream without the use of binder materials.

24. The system of claim 22 wherein said means for supplying a heated pressurized gas steam comprises a furance.

25. The system of claim 24 wherein said means for supplying a heated pressurized gas stream further comprises means for recycling said heated pressurized gas stream through said furnace and said means for heating.

26. The system of claim 25 wherein said means for separating includes a primary cyclone and a plurality of secondary cyclones, and said means for recycling includes: first duct means interconnecting said outlet and said primary cyclone of said means of separating; second duct means interconnecting said primary cyclone and said plurality of secondary cyclones of said means for separating; third duct means interconnecting said plurality of secondary cyclones and a fourth duct means, said fourth duct means diverging into an exhaust duct and a recycle duct; said recycle duct having a fan therein and interconnecting said third duct means and said furnace; and fifth duct means interconnecting said furnace and said inlet; said fan maintaining said first duct means, said second duct means, said third duct means, said recycle duct and said fifth duct means under a pressure greater than atmospheric pressure.

27. The system of claim 26 wherein said exhaust duct communicates with a baghouse and a baghouse bypass located externally of said baghouse, said baghouse bypass including a first damper.

28. The system of claim 27 wherein said means for recombining further comprises means for collecting both particles separated by and then discharged from said primary cyclone and said secondary cyclones, and particles filtered by and then discharged from said baghouse.

29. The system of claim 28 wherein said means for recombining further comprise product bin means for receiving at least a portion of the particles collected by said means for collecting.

30. The system of claim 29 wherein said means for recombining further comprises means for introducing a controlled quantity of furnace combustion gases into said means for collecting and into said product bin means to render the respective atmospheres thereof essentially non-combustible.

31. The system of claim 30 wherein said means for recombining further comprises means for precompacting particles dispensed from said product bin means.

32. The system of claim 31 wherein said means for recombining further comprises means for forming precompacted particles received from said means for precompacting into a final product.

33. The system of claim 32 further comprising means for spraying a quantity of water on said final product sufficient to provide evaporative cooling of said final product without saturating said final product.

34. The system of claim 29 further comprising means for detecting the load of particles in said product bin means, said means for detecting controlling the rate of feed of said means for delivering in response to the load detected in said product bin means.

35. The system of claim 29 further comprising fuel bin means for receiving at least a portion of the particles discharged by said secondary cyclones and said baghouse and collected by said means for collecting.

36. The system of claim 35 further comprising means for rendering the atmosphere of said fuel bin means essentially non-combustible.

37. The system of claim 36 further including means for delivering the particles received in said fuel bin means to said furnace for combustion therein.

38. The system of claim 37 wherein said furnace combusts particles delivered from said fuel bin means and those portions of particles entrained in said gas stream which are recycled in said recycle duct and not separated by said primary cyclone and said secondary cyclones.

39. The system of claim 26 further comprising means for simulating an evaporative load and a heat sink normally provided by said particulate material during normal operating conditions of said system, said means for simulating an evaporative load and a heat sink being used for phased start-up and shut-down of said system.

40. The system of claim 39 wherein said means for simulating an evaporative load and a heat sink comprise water spray means located within said means for heating.

41. The system of claim 40 wherein said means for simulating an evaporative load and a heat sink further comprise a second damper positioned within said recycle duct.

42. The system of claim 26 further comprising means located in said exhaust duct for controlling and maintaining positive design static pressures in said system.

43. The system of claim 42 wherein said means for controlling and maintaining positive design static pressures comprises a third damper.

* * * * *